US009816526B2

(12) United States Patent
Heli

(10) Patent No.: US 9,816,526 B2
(45) Date of Patent: Nov. 14, 2017

(54) WALL RING FOR A FAN WITH HEATING ELEMENT

(71) Applicant: ebm-papst Mulfingen GmbH & Co. KG, Mulfingen (DE)

(72) Inventor: Thomas Heli, Langenburg (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 321 days.

(21) Appl. No.: 14/427,071

(22) PCT Filed: Aug. 22, 2013

(86) PCT No.: PCT/EP2013/067475

§ 371 (c)(1),
(2) Date: Mar. 10, 2015

(87) PCT Pub. No.: WO2014/040835

PCT Pub. Date: Mar. 20, 2014

(65) Prior Publication Data

US 2015/0219117 A1 Aug. 6, 2015

(30) Foreign Application Priority Data

Sep. 11, 2012 (DE) ..... 10 2012 108 449

(51) Int. Cl.
*F04D 29/58* (2006.01)
*F04D 29/42* (2006.01)
(Continued)

(52) U.S. Cl.
CPC ..... *F04D 29/5853* (2013.01); *F04D 19/002* (2013.01); *F04D 29/4226* (2013.01); *F04D 29/526* (2013.01); *F04D 29/584* (2013.01)

(58) Field of Classification Search
CPC ..... F04D 29/5853; F04D 19/002; F04D 29/4226; F04D 29/526; F04D 29/584
See application file for complete search history.

(56) References Cited

U.S. PATENT DOCUMENTS 1,991,280 A 2/1935 Hynes
2,133,188 A * 10/1938 Conforti ..... F04D 29/526 219/220

(Continued)

FOREIGN PATENT DOCUMENTS

DE 20 2005 012 394 U1 12/2005
DE 10 2008 050 895 A1 4/2010

(Continued)

OTHER PUBLICATIONS

German Search Report in DE 10 2012 108 449.1, Oct. 24, 2013, with translation of relevant parts.

(Continued)

*Primary Examiner* — Gregory Anderson
*Assistant Examiner* — Eldon Brockman
(74) *Attorney, Agent, or Firm* — Collard & Roe, P.C.

(57) ABSTRACT

A wall ring for a fan, with a fan wheel, includes at least one heating element for heating the wall ring. The heating element includes an electrically conductive heating layer which is disposed on the inner side of the wall ring facing the fan wheel. The electrically conductive heating layer of the heating element may be configured as an electrically conductive CNT coating having carbon nano-materials.

7 Claims, 4 Drawing Sheets

Figure 1:
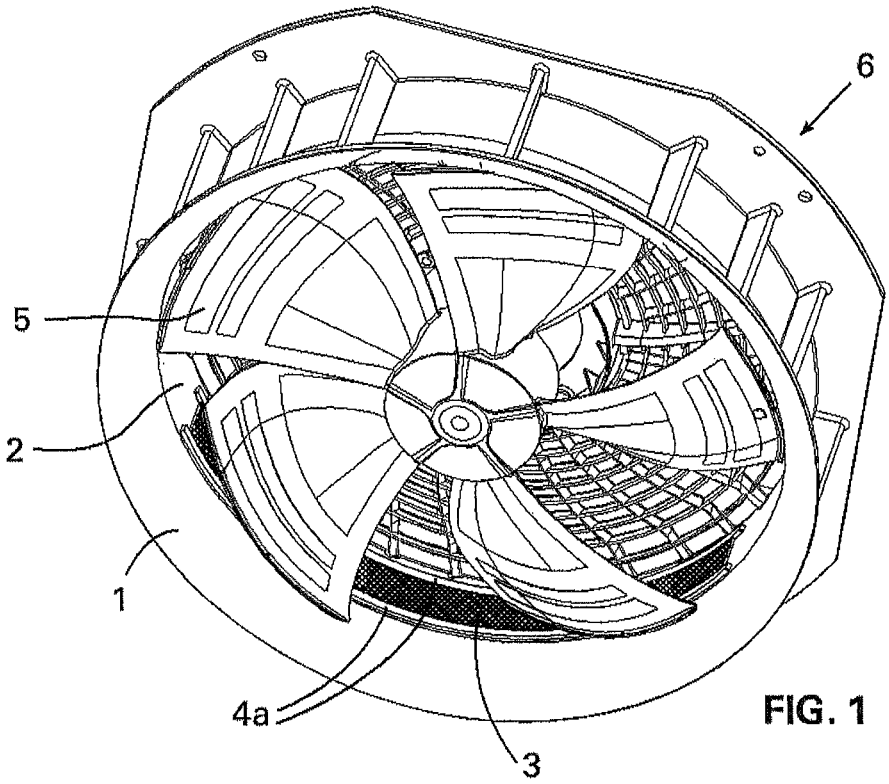
Figure 2:
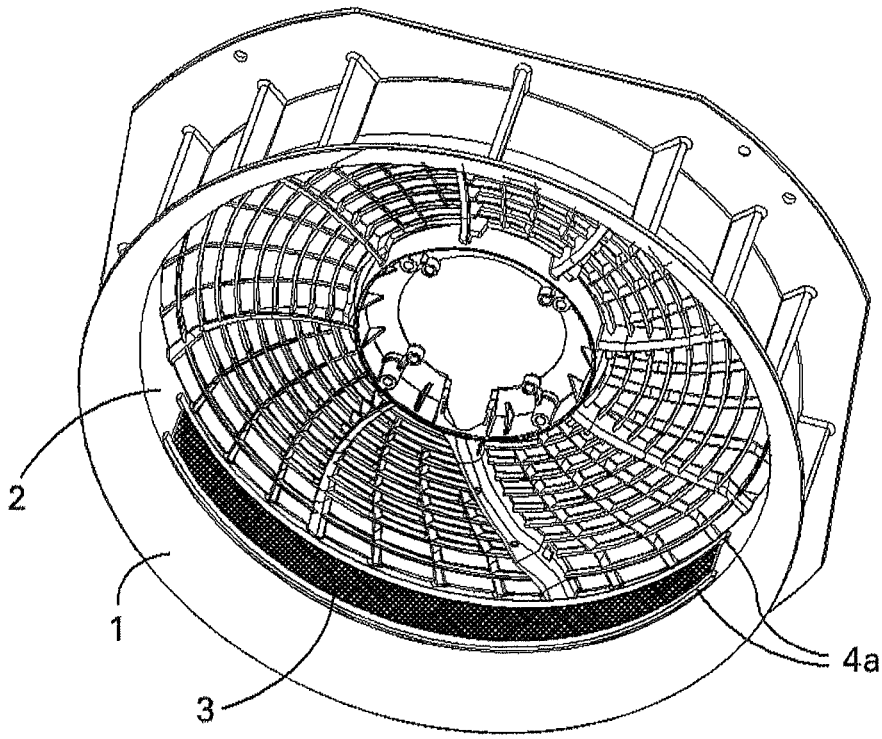

(51) Int. Cl.
*F04D 29/52* (2006.01)
*F04D 19/00* (2006.01)

(56) References Cited

U.S. PATENT DOCUMENTS 3,211,891 A * 10/1965 Kendall ..... F24H 3/0405 338/280
3,465,124 A 9/1969 Sauer
3,525,851 A 8/1970 Seabury, Jr.
4,090,061 A * 5/1978 Glucksman ..... F24H 3/0405 338/294
4,162,395 A * 7/1979 Kobayashi ..... F24H 3/0405 219/504
7,168,917 B2 * 1/2007 Bronaugh ..... F24H 3/0405 415/177
7,560,663 B2 7/2009 Schehr
9,193,466 B2 * 11/2015 Calder ..... B64D 15/12
9,261,100 B2 * 2/2016 Koplow ..... F04D 25/0606
2005/0123396 A1 * 6/2005 Bronaugh ..... F24H 3/0405 415/176
2006/0209532 A1 9/2006 Hardgrave
2010/0155538 A1 * 6/2010 Calder ..... B64D 15/12 244/134 D
2011/0036826 A1 * 2/2011 Feng ..... F24C 7/06 219/409
2012/0180992 A1 * 7/2012 Koplow ..... F04D 25/0606 165/104.21
2014/0014640 A1 * 1/2014 Calder ..... B64D 15/12 219/202
2016/0116232 A1 * 4/2016 Koplow ..... F04D 25/0606 165/109.1

FOREIGN PATENT DOCUMENTS

DE 10 2009 049 628 A1 5/2010
DE 10 2009 002 469 A1 10/2010
GB 2 189 119 A 10/1987

OTHER PUBLICATIONS

International Search Report of PCT/EP2013/067475, dated Nov. 29, 2013.
Letter from German patent attorney to European Patent Office dated Jan. 24, 2014 in PCT/EP2013/067475.

* cited by examiner

WALL RING FOR A FAN WITH HEATING ELEMENT

CROSS REFERENCE TO RELATED APPLICATIONS

This application is the National Stage of PCT/EP2013/067475 filed on Aug. 22, 2013, which claims priority under 35 U.S.C. §119 of German Application No. 10 2012 108 449.1 filed on Sep. 11, 2012, the disclosures of which are incorporated by reference. The international application under PCT article 21(2) was not published in English.

The invention is directed not only at a wall ring for a fan, comprising at least one heating element for heating the wall ring, but also at a fan, comprising a fan wheel and a heated wall ring, wherein the wall ring encloses the fan wheel of the fan.

Fans, particularly axial fans, are used, among others, in applications at very low temperatures, such as, for example, for heat pumps or for evaporators in cold-storage rooms. Such fans generally comprise a fan wheel and a wall ring that surrounds the fan wheel. In this connection, there is the risk of ice formation on the wall ring, and therefore the blades of the fan wheel can freeze up on the wall ring. In order to prevent such freeze-up, an electric resistance heating system is typically applied around the wall ring of the fan, from the outside, in known fans, and the wall ring is heated. In this connection, it is disadvantageous that a large amount of energy must be introduced in order to heat the wall ring through sufficiently and to melt the ice on the inner side of the wall ring. This is particularly problematical if the wall ring consists of materials that have only low heat conductivity. Furthermore, in this connection, a high proportion of the heat energy is given off to the surroundings, and this is undesirable, particularly in the case of cold-storage rooms, because this additional heat energy then has to be extracted from the cold-storage room later. Furthermore, in electric resistance heating systems, a line voltage of 230V is generally used, and this can represent a safety problem under some circumstances.

In the document US 2006/0209532 A1, a fan configured as a chandelier, having a wall ring for the fan, is described, in which an electric heating coil is disposed on the inner circumference of the wall ring, in order to heat the air that flows through the fan.

The document US 2005/0123396 A1 describes an electric oven having a wall ring for a fan, in which the housing of the fan heats the air that flows through the fan. The housing is particularly produced from a duroplastic material and impregnated with graphite or cast together with a graphite material, whereby heat is generated by means of an electric voltage applied to the housing.

From the document U.S. Pat. No. 1,991,280 A, an electric heating system having a wall ring for a fan is known, in which an electric heating ring is affixed on the inner circumference of the wall ring.

In the document U.S. Pat. No. 3,465,124 A, an electric oven having a fan is described, in which multiple heating elements for heating the air are disposed on the circumference of the fan.

The document U.S. Pat. No. 3,525,851 A describes an electric oven having a wall ring for a fan, in which electric heating elements are disposed in the wall ring.

From the document DE 20 2005 012 394 U1, an electric heating module for heating room air and having a fan is known, in which PTC heating elements radially distributed in the housing of the fan heat the air stream through the fan.

In the document GB 2 189 119 A, a heating fan is described, in which a heating element that runs along the circumference is disposed in the fan housing and heats the air stream by means of thermal conductors affixed to the heating element.

All the known fans mainly serve to heat the air stream and to achieve a heating effect for the surroundings by means of the fan. The heating elements require relatively great power with great energy consumption and are very complicated to produce.

The invention is therefore based on the task of making available a wall ring for a fan, which ring prevents icing of the wall ring and thereby freeze-up of the fan in particularly energy-efficient and reliable manner.

In a wall ring of the type described initially, the task is accomplished, according to the invention, in that the heating element comprises an electrically conductive heating layer that is disposed on the inner side of the wall ring, facing the fan wheel.

By means of the placement of the heating element on the inner side of the wall ring, between the inner side of the wall ring and the ends of the fan blades of the fan wheel, the heating element is disposed where ice predominantly forms. Because the heating element is disposed on the surface of the wall ring that faces the fan wheel, it prevents the formation of ice, by means of direct heating of the heating element, in that partial region of the wall ring that is covered by the heating element. Furthermore, the heating element heats its surroundings by means of heat conduction and heat radiation. The heat conduction and heat radiation additionally act on the regions of the inner side of the wall ring not covered by the heating element, and, in particular, rapidly heat the surface of the inner side of the wall ring that borders on the heating element. In this way, the formation of ice on the inner side of the wall ring, in the relevant surface region, is prevented, without the wall ring having to be completely covered with the heating element. Furthermore, the air in a gap between wall ring and fan blades and the ends of the fan blades are heated by means of the heat radiation of the heating element. This additionally prevents ice formation at the ends of the fan blades.

In an embodiment of the invention, the electrically conductive heating layer of the heating element is configured as an electrically conductive lacquer, particularly as a CNT lacquer having carbon nano-materials. In this way, the heating element can be applied in particularly simple manner, by means of a varnishing process during production of the wall ring, particularly also on complex surface structures. Furthermore, the heating element can be applied in particularly thin manner, so that the air stream within the wall ring and the movement of the blades is not influenced or only influenced to a negligible extent. The lacquer layer according to the invention allows particularly uniform and area-wide heating of the wall ring. Furthermore, such a heating element is particularly energy-efficient, so that a reduction of the required heat energy, particularly to as low as between 0.5 W and 12 W, is possible.

Alternatively, the electrically conductive heating layer of the heating element is configured as an electrically conductive adhesive tape, particularly having a layer of carbon nano-materials. This allows simple and cost-advantageous installation of a heating element by means of manual or mechanical adhesive attachment, particularly also after the fact, on a wall ring of a fan that has already been installed.

For a further embodiment of the invention, the heating element covers only a partial region of the inner side of the wall ring that runs in the circumferential direction and/or runs only over a partial region of the inner side of the wall ring that runs in the axial direction. This makes it possible, on the one hand, to save material costs, in that only the partial regions of the wall ring that are critical for protection against icing are covered by the heating element, and, on the other hand, to adapt the energy demand to specific sizes of the wall ring and/or operating parameters of the fan for which the wall ring is intended.

In an embodiment of the invention, the heating element has contacting by means of contact elements on its side edges that run in the axial direction, so that the direction of an electric current flowing through the heating element faces in the circumferential direction of the wall ring.

In an alternative embodiment of the invention, the heating element has contacting by means of contact elements on its side edges that run in the circumferential direction, so that the direction of a current that flows through the heating element faces in the axial direction of the wall ring.

In particular, in an embodiment of the invention, multiple heating elements are disposed distributed on the inner side of the wall ring, facing the fan wheel, and their contact elements are connected in parallel or in series. This allows particularly flexible and energy-optimized positioning of the heating elements for a specific use of the fan, with the lowest possible material expenditure for the heating element.

In an embodiment of the invention, the heating element is designed for a low voltage between 3 V and 60 V, particularly for 12 V or 24 V. This has the advantage that the risk of spark formation or electric shocks at a higher line voltage is avoided.

Further details, characteristics, and advantageous further developments of the invention are evident from the following exemplary embodiment, described below and shown in the drawing, as well as from the dependent claims. The drawing shows:

FIG. 1 a sketch-like representation of a fan having a wall ring according to the invention, FIGS. 2 to 7 different wall rings in alternative embodiments.

In the different figures of the drawing, the same parts are always provided with the same reference symbols.

With regard to the following description, it is explicitly emphasized that the invention is not restricted to the exemplary embodiments, and, in this connection, not to all or multiple characteristics of combinations of characteristics that are described; instead, each individual partial characteristic of the/each exemplary embodiment can also have inventive significance in and of itself and also in combination with any desired characteristics of another exemplary embodiment, as well as also independent of the combinations of characteristics and antecedents of the claims.

In FIG. 1, a wall ring 1 for a fan is shown. In the assembled state of the wall ring 1, a fan wheel 5 of the fan 6 is situated within the wall ring 1, as shown. The wall ring 1 particularly has a cylindrical basic shape and an inner side 2 that faces the fan wheel 5. A heating element 3 for heating the wall ring 1 is disposed on the inner side 2 of the wall ring 1, which faces the fan wheel 5. The heating element 3 comprises an electrically conductive heating layer. In the embodiment shown, the heating element 3 does not cover the entire surface of the inner side 2, but rather only a partial region of the inner side 2 of the wall ring 1. In this connection, the heating element 3 covers a partial region of the inner side 2 that runs in the circumferential direction and/or a partial region of the inner side 2 that runs n the axial direction. Alternatively, it is also possible that the entire region of the inner side 2 is covered in the circumferential direction and/or the axial direction.

The electrically conductive heating layer of the heating element 3 is configured as an electrically conductive lacquer in a preferred exemplary embodiment. The lacquer is particularly produced as a CNT lacquer and comprises carbon nano-materials. Alternatively, the electrically conductive heating layer of the heating element 3 is configured as an electrically conductive adhesive tape. In this case, the adhesive tape particularly comprises a CNT lacquer layer having carbon nano-materials.

Fundamentally, the size and the positioning of the heating element 3 can be different, depending on the application parameters, whereby for cost reasons, the heating element 3 covers smallest possible surface and is configured as the thinnest possible layer. In this connection, the heating output must allow sufficient protection against icing. In the exemplary embodiment shown, the heating element 3 covers approximately one third of the circumference of the inner side 2 of the wall ring 1. In this connection, the heating element 3 is positioned in such a manner that it is situated where icing would predominantly occur in the operating state of the fan 6.

In the embodiments in FIGS. 1, 2, 5, and 6, the heating element 3 has contacting by means of contact elements 4*a* on its side edges that run in the circumferential direction, so that the direction of a current that flows through the heating element 3 faces in the axial direction of the wall ring 1.

Figure 3:
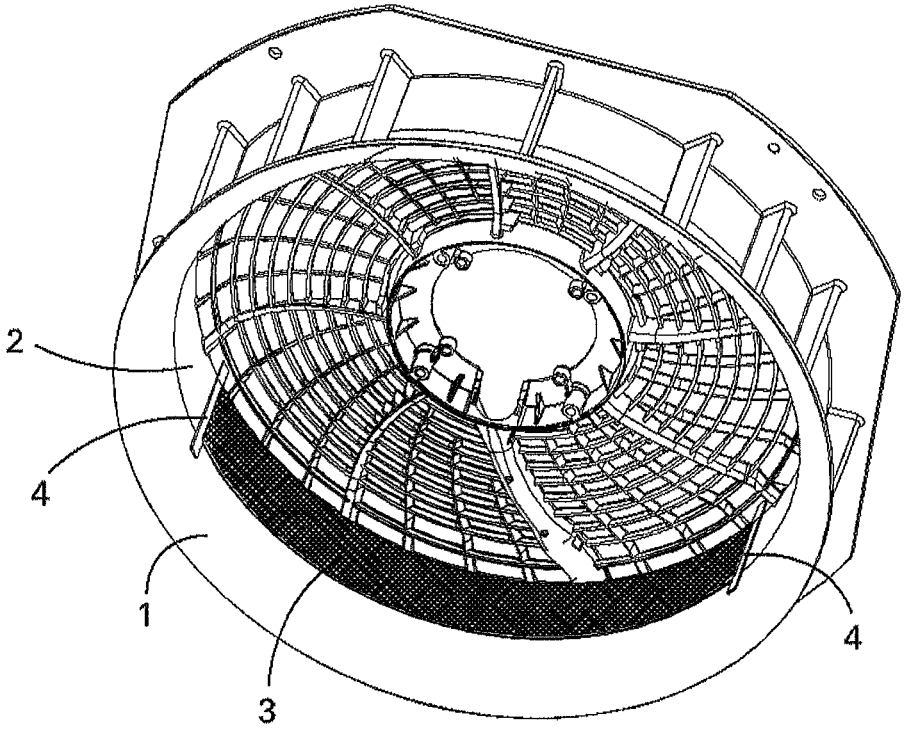
Figure 4:
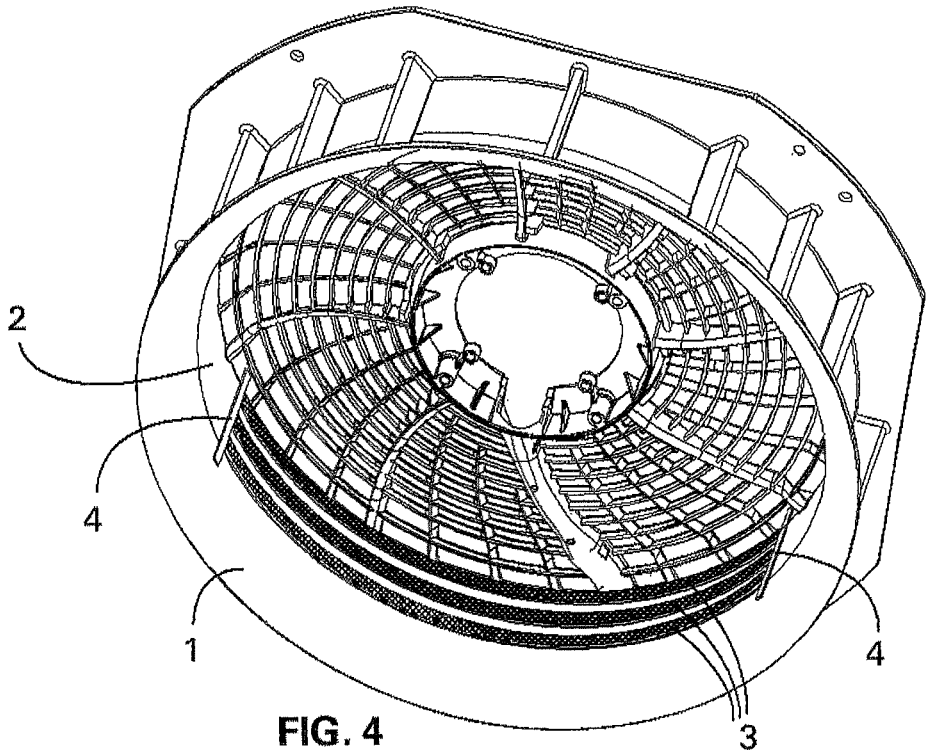
Figure 5:
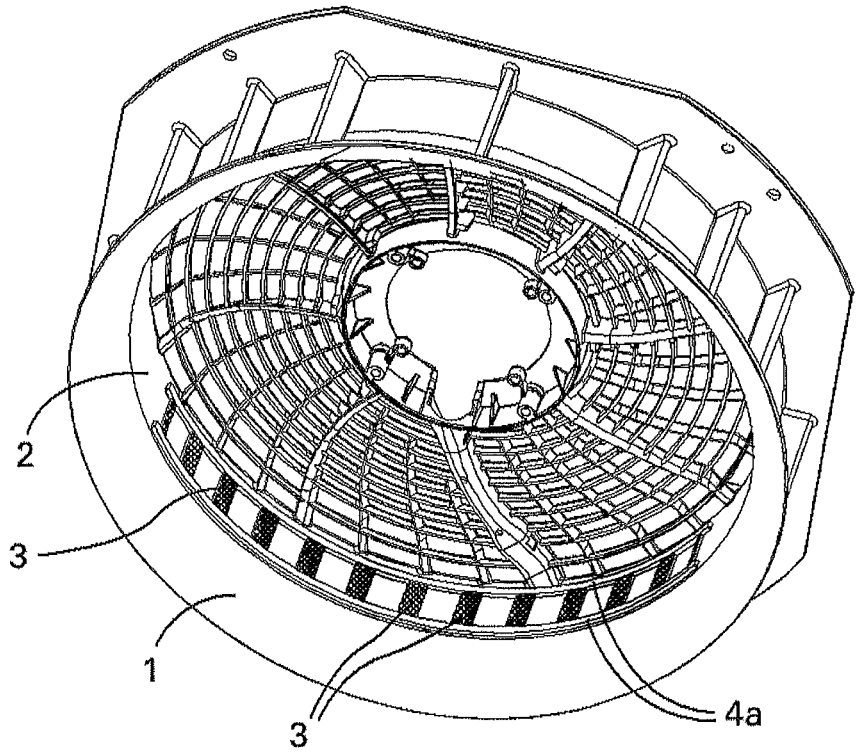
Figure 6:
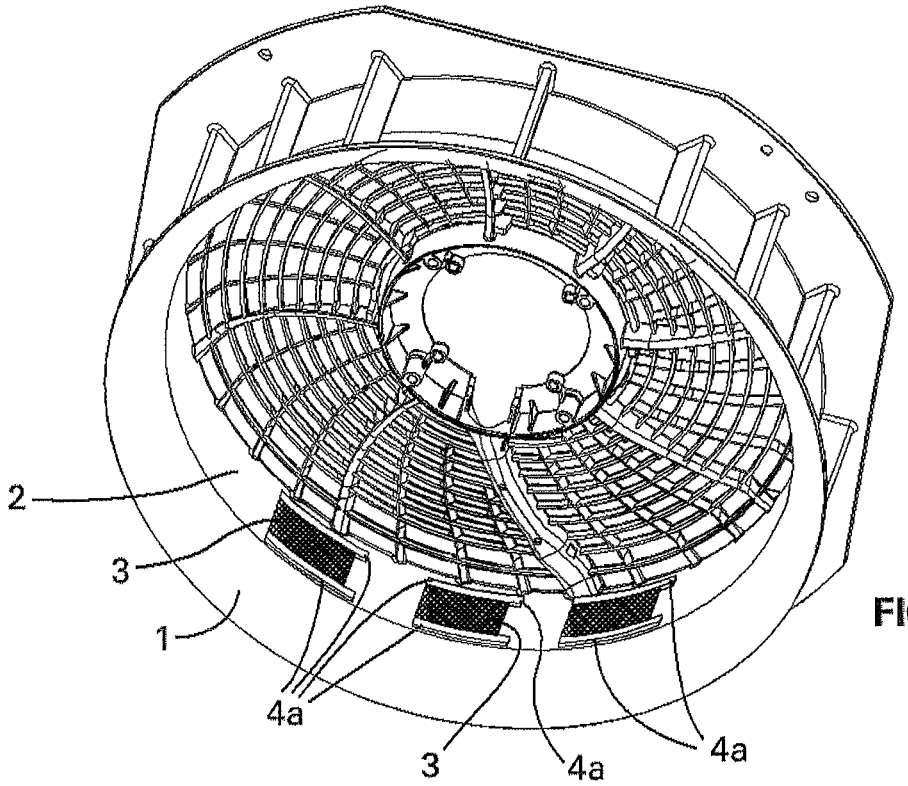
Figure 7:
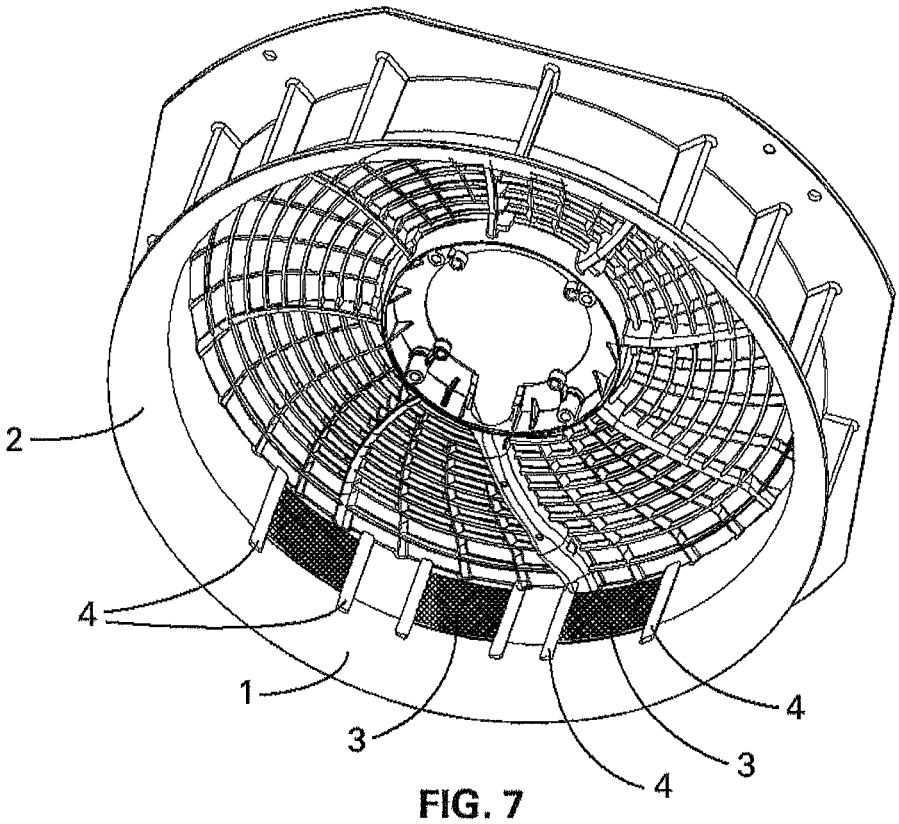

In the embodiments in FIGS. 3, 4, and 7, the heating element 3 has contacting by means of contact elements 4 on its side edges that run in the axial direction, so that the direction of a current that flows through the heating element 3 faces in the circumferential direction of the wall ring 1.

As shown in FIGS. 4, 5, 6, and 7, it is also possible that multiple heating elements 3 are disposed distributed on the inner side 2 of the wall ring 1, and that its contact elements 4, 4*a* are connected in parallel or in series. Alternatively, the heating element 3 can cover the entire circumference of the inner side 2 of the wall ring 1, in the circumferential direction, with the exception of an insulation gap that runs axially. By means of distributing the heating elements 3 over the circumference of the wall ring 1, protection against icing is made possible independent of the installation position of the fan 6.

The heating element 3 is designed for a low voltage between 3 V and 60 V, particularly for 12 V or 24 V.

By applying an operating voltage to the wiring of the heating element 3, current flows through the heating element 3, which thereby heats up, thereby preventing ice formation in the region of the heating element 3. Furthermore, heat is given off by the heating element 3 by means of heat conduction and heat radiation, into the surroundings of the heating element 3, particularly to the surface of the inner side 2 of the wall ring 1. The heating element 3 is positioned on the inner side 2 of the wall ring 1 in such a manner that the heating element 3 covers the region of the inner side 2 at which icing would predominantly occur in the operating state of the fan 6.

The invention is not restricted to the exemplary embodiments that are shown and described, but rather also covers all the embodiments that have the same effect in the sense of the invention. It is explicitly emphasized that the exemplary embodiments are not restricted to all the characteristics in combination, but instead, each individual partial characteristic can also have inventive significance on its own, separate from all the other partial characteristics. Furthermore, the invention has also not been restricted to the combination of characteristics defined in each independent claim, until now, but rather can also be defined by any other desired combination of specific characteristics of all the individual characteristics disclosed in total. This means that fundamentally, practically any individual characteristic of each independent claim can be left out or replaced with at least one individual characteristic disclosed at another point in the application. In this regard, the claims should be understood as being merely a preliminary formulation attempt for an invention.

The invention claimed is:

1. A wall ring for a fan having a fan wheel, comprising at least one heating element for heating the wall ring;

wherein the heating element comprises an electrically conductive heating layer that is disposed on an inner side of the wall ring that faces the fan wheel;

wherein the electrically conductive heating layer of the heating element is configured as an electrically conductive CNT lacquer having carbon nano-materials; and wherein the heating element has contact elements on side edges that run in the axial direction, so that the direction of a current flowing through the heating element faces in the circumferential direction of the wall ring.

2. The wall ring according to claim 1, wherein the heating element covers a partial region of the inner side of the wall ring that runs in the circumferential direction.

3. The wall ring according to claim 1, wherein the heating element covers a partial region of the inner side of the wall ring that runs in the axial direction.

4. The wall ring according to claim 1, wherein multiple heating elements are disposed distributed on the inner side of the wall ring, facing the fan wheel, and their contact elements are connected in parallel or in series.

5. The wall ring according to claim 1, wherein the heating element is designed for a low voltage between 3 V and 60 V.

6. A fan comprising the fan wheel and the wall ring according to claim 1, wherein the wall ring encloses the fan wheel of the fan.

7. A wall ring for a fan having a fan wheel, comprising at least one heating element for heating the wall ring;

wherein the heating element comprises an electrically conductive heating layer that is disposed on an inner side of the wall ring that faces the fan wheel;

wherein the electrically conductive heating layer of the heating element is configured as an electrically conductive CNT lacquer having carbon nano-materials; and wherein the heating element covers the entire circumference of the inner side of the wall ring, in the circumferential direction, with the exception of an insulation gap that runs axially.

* * * * *